US010453433B2

(12) United States Patent
Hirai et al.

(10) Patent No.: US 10,453,433 B2
(45) Date of Patent: Oct. 22, 2019

(54) TONE BAR WOODY MATERIAL, TONE BAR PERCUSSION INSTRUMENT, AND PRODUCTION METHOD OF TONE BAR WOODY MATERIAL

(71) Applicant: YAMAHA CORPORATION, Hamamatsu-shi (JP)

(72) Inventors: Eri Hirai, Hamamatsu (JP); Kazuki Soga, Hamamatsu (JP); Tatsuya Hiraku, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/798,531

(22) Filed: Oct. 31, 2017

(65) Prior Publication Data

US 2018/0122343 A1 May 3, 2018

(30) Foreign Application Priority Data

Nov. 1, 2016 (JP) ..... 2016-214132

(51) Int. Cl.
*G10D 13/08* (2006.01)
*G10D 13/06* (2006.01)
(Continued)

(52) U.S. Cl.
CPC ..... *G10D 13/08* (2013.01); *B27K 3/0221* (2013.01); *B27K 3/08* (2013.01); *B27K 3/15* (2013.01); *G10D 13/06* (2013.01)

(58) Field of Classification Search
CPC ..... G10D 13/08; G10D 13/06; B27K 3/0221; B27K 3/08; B27K 3/15
(Continued)

(56) References Cited

U.S. PATENT DOCUMENTS 2,017,797 A * 10/1935 Gardner ..... D21H 17/49 427/354
3,354,247 A * 11/1967 Zehender ..... C08J 9/24 264/119
(Continued)

FOREIGN PATENT DOCUMENTS

CN 105835193 A 8/2016
JP 02073397 A * 3/1990
(Continued)

OTHER PUBLICATIONS

Extended European Search Report issued in European Appln. No. 17199127.6 dated Mar. 15, 2018.
(Continued)

*Primary Examiner* — David S Warren
*Assistant Examiner* — Christina M Schreiber
(74) *Attorney, Agent, or Firm* — Rossi, Kimms & McDowell LLP

(57) ABSTRACT

An object of the present invention is to provide a tone bar woody material and a xylophone that are superior in acoustic characteristics and stable in quality. In the tone bar woody material of the present invention, at least a partial region of a surface layer of a wood material was impregnated with a resin composition, and the wood material comprises in the partial region, a plurality of pores each having an average diameter less than 1.2 times an average diameter of vessels in the wood material.

8 Claims, 3 Drawing Sheets

(51) Int. Cl.
*B27K 3/02* (2006.01)
*B27K 3/08* (2006.01)
*B27K 3/15* (2006.01)

(58) Field of Classification Search
USPC ..... 84/403
See application file for complete search history.

(56) References Cited

U.S. PATENT DOCUMENTS 3,419,645 A * 12/1968 Pelz ..... C04B 35/521 423/460
3,427,186 A * 2/1969 Hudson ..... B27K 3/005 427/440
3,464,853 A * 9/1969 La May ..... B27K 3/0214 427/393
3,511,691 A * 5/1970 Crooks ..... C08G 18/3228 427/351
3,551,362 A * 12/1970 Decker ..... C08G 8/38 521/70
3,795,533 A * 3/1974 Gauri ..... B27K 3/15 428/218
4,568,564 A * 2/1986 Witt ..... B27K 3/15 427/487
5,017,669 A * 5/1991 Young ..... C08F 20/18 526/212
5,469,769 A * 11/1995 Sawada ..... B32B 7/02 84/193
6,087,568 A * 7/2000 Seal ..... G10D 1/005 84/193
8,361,612 B2 * 1/2013 Komatsu ..... B29C 45/0013 264/45.3
2012/0197526 A1 * 8/2012 Leyte Guerrero ... G01N 15/088 702/2
2016/0136553 A1 * 5/2016 Healey ..... B01D 39/163 55/486
2017/0283565 A1 * 10/2017 Ono ..... B32B 29/00
2017/0313831 A1 * 11/2017 Kakutani ..... B32B 5/28
2018/0122343 A1 * 5/2018 Hirai ..... G10D 13/08

FOREIGN PATENT DOCUMENTS

JP H02073397 A 3/1990
JP H08314448 A 11/1996
JP 2004240342 A * 8/2004
JP 2004240342 A 8/2004

OTHER PUBLICATIONS

Office Action issued in Chinese Appln. No. 201711057602.0 dated Mar. 4, 2019. English translation provided.
Office Action issued in Japanese Appln. No. 2016-214132 dated Mar. 26, 2019. English translation provided.

* cited by examiner

TONE BAR WOODY MATERIAL, TONE BAR PERCUSSION INSTRUMENT, AND PRODUCTION METHOD OF TONE BAR WOODY MATERIAL

BACKGROUND OF THE INVENTION

The present invention relates to a tone bar woody material, a tone bar percussion instrument, and a production method of a tone bar woody material.

DESCRIPTION OF THE RELATED ART

A tone bar percussion instrument produces sound when a tone bar is struck and vibrated. For example, xylophones such as a marimba each have a plurality of tone bars corresponding to a plurality of musical notes. Conventionally, tone bars of xylophones are produced from natural wood such as rosewood. However, in recent years, high-quality wood resources are being depleted, and thus it is getting extremely difficult to obtain a quality tone bar material.

In this regard, a tone bar material has been proposed which is obtained by impregnating a relatively inexpensive wood material with a resin, and has improved acoustic characteristics (see Japanese Unexamined Patent Application, Publication No. H8-314448). The aforementioned publication describes that, due to impregnating with a thermosetting resin the only cell walls of the wood material used as the tone bar material, inhibition of deterioration of rising of sound (i.e., acoustic response) and reduction of acoustic loss are enabled, while surface hardness and modulus of elasticity are increased.

In the tone bar material disclosed in the aforementioned publication, a resin diluted with a solvent is used in order to facilitate impregnation of the wood material with the resin. However, there is a disadvantage that an impregnation amount is likely to vary due to individual variability of natural wood and non-homogeneous texture in an individual piece of the natural wood.

PRIOR ART DOCUMENTS

Patent Documents

Patent Document 1: Japanese Unexamined Patent Application, Publication No. H8-314448

SUMMARY OF THE INVENTION

Problems to be Solved by the Invention

In view of the disadvantage described above, an object of the present invention is to provide a tone bar woody material and a tone bar percussion instrument that are superior in acoustic characteristics and stable in quality.

Means for Solving the Problems

According to an aspect of the invention made for solving the aforementioned problems, in a tone bar woody material, at least a partial region of a surface layer of a wood material was impregnated with a resin composition, and the wood material comprises in the partial region, a plurality of pores each having an average diameter less than 1.2 times an average diameter of vessels in the wood material.

A central axis direction of the plurality of pores is preferably substantially perpendicular to a surface of the wood material.

An average diameter of the plurality of pores is preferably no less than 10 μm and no greater than 500 μm, and an average depth of the plurality of pores is preferably no less than 0.1 mm and no greater than 10 mm.

An average pitch of the plurality of pores is preferably no less than 0.2 mm and no greater than 10 mm.

The number of the plurality of pores per unit area is preferably no less than 14 pores/cm$^2$ and no greater than 900 pores/cm$^2$.

According to another aspect of the invention made for solving the aforementioned problems, a tone bar percussion instrument comprises a tone bar woody material wherein at least a partial region of a surface layer of a wood material was impregnated with a resin composition, and the wood material comprises in the partial region, a plurality of pores each having an average diameter less than 1.2 times an average diameter of vessels in the wood material.

According to still another aspect of the invention made for solving the aforementioned problems, a production method of a tone bar woody material, wherein at least a partial region of a surface layer of a wood material was impregnated with a resin composition, comprises: forming a plurality of pores in the partial region of the wood material; impregnating with a resin composition the wood material comprising the plurality of pores formed therein; and hardening the resin composition with which the wood material had been impregnated, wherein the plurality of pores each have an average diameter less than 1.2 times an average diameter of vessels in the wood material.

The impregnating preferably comprises: impregnating the wood material with the resin composition while deaerating the wood material under reduced pressure; and impregnating the wood material with the resin composition under ordinary pressure.

The term "surface layer" as referred to means a region in the vicinity of an external surface, encompassing regions in the vicinity of a back face and a lateral face of the wood material. The term "substantially perpendicular" as referred to means that an inclination angle from a normal direction is no greater than 10° and preferably no greater than 3°. The term "average diameter" as referred to means an averaged value of equivalent circle diameters measured with an optical microscope. The term "average depth" as referred to means an averaged value of maximum depths of respective pores. The term "average pitch" as referred to means an averaged value of distances between: centers of two pores each being closest to a plurality of pores as standards; and centers of the pores as standards.

DESCRIPTION OF EMBODIMENTS

Embodiments of the present invention will be described in detail hereinafter, with appropriate reference to the drawings.

Tone Bar Woody Material

Figure 1:
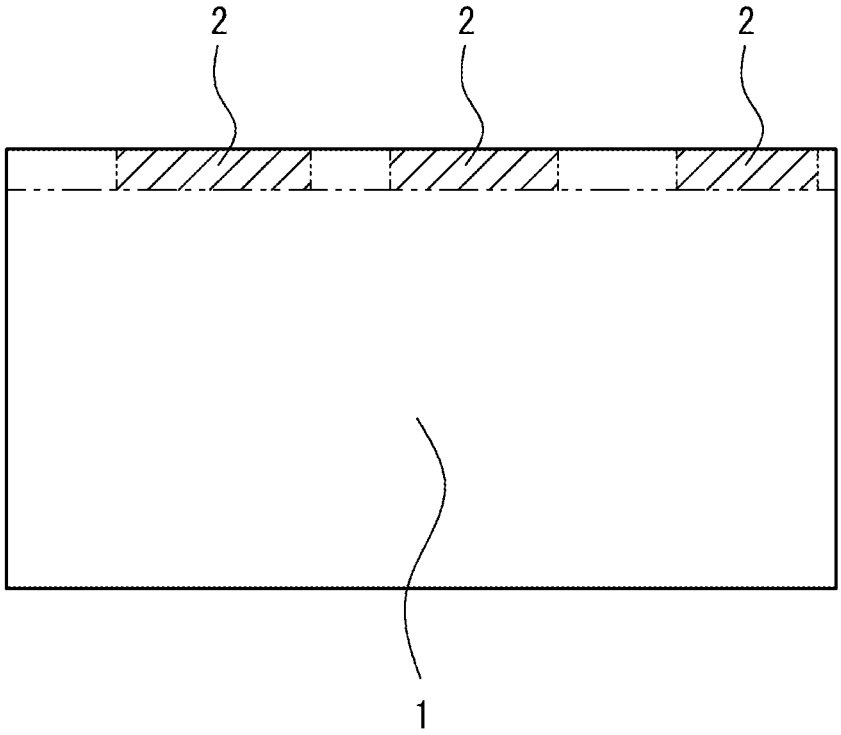
FIG. 1 is a schematic lateral view illustrating a tone bar woody material according to an embodiment of the present invention.
Figure 2:
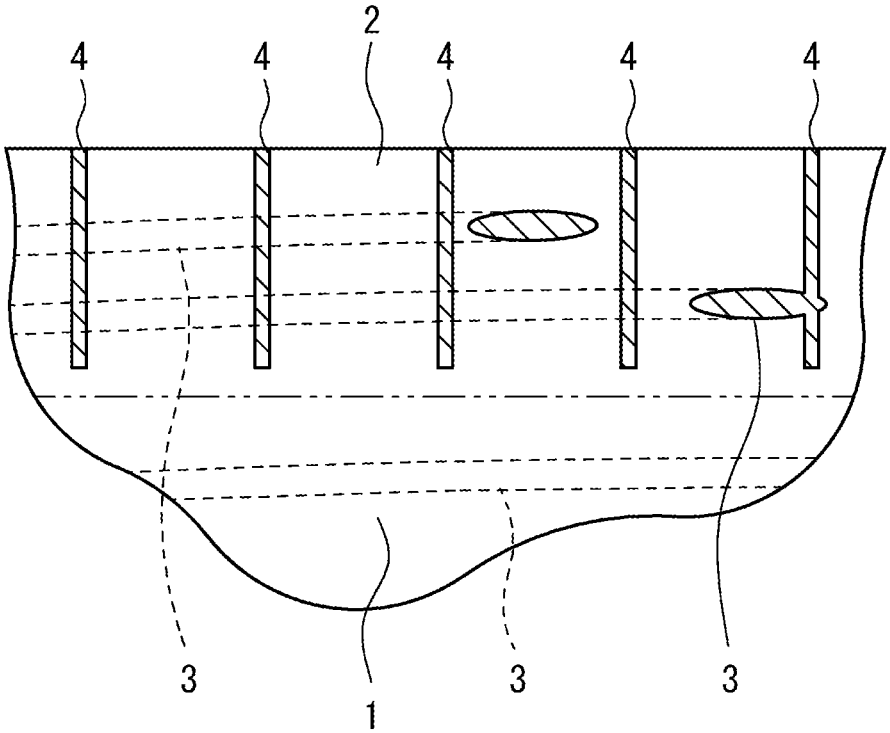
FIG. 2 is a schematic partial enlarged cross sectional view of the tone bar woody material of FIG. 1.

In the tone bar woody material according to an embodiment of the present invention illustrated in FIG. 1, at least a partial region of a surface layer of a wood material 1 is impregnated with a resin composition 2. In addition, as illustrated in detail in FIG. 2, the tone bar woody material of the present embodiment has a plurality of pores 4 formed in the partial region of the surface layer of the wood material 1 to be impregnated with the resin composition 2, the plurality of pores 4 each having an average diameter comparable to or less than an average diameter of vessels 3 in the wood material 1.

In the tone bar woody material of the present embodiment, the region to be impregnated with the resin composition 2 is preferably a region which is to serve as a struck surface of the tone bar for a tone bar percussion instrument formed from the tone bar woody material. Accordingly, production of high-class sound is enabled through an improvement of vibration characteristics of the wood material 1 which is relatively inexpensive, while an increase in durability of the struck surface is enabled.

Wood Material

The wood material 1 is cut out from natural wood, and is typically a board material.

The lower limit of a relative density of dry wood of the wood material 1 is preferably 0.5 and more preferably 0.6. Meanwhile, the upper limit of the relative density of dry wood of the wood material 1 is preferably 1.2 and more preferably 1.1. When the relative density of dry wood of the wood material 1 is less than the lower limit, sufficient acoustic characteristics may not be obtained even by the impregnation with the resin composition 2. To the contrary, when the relative density of dry wood of the wood material 1 is greater than the upper limit, processibility may be insufficient and/or the tone bar woody material may be unduly expensive.

A type of tree of the wood material 1 is exemplified by rosewood, padauk, amboyna, maple, hard maple, hornbeam, Japanese beech, oak, matoa, mahogany, and the like. Of these, padauk and amboyna are suitably used, that give a tone bar woody material superior in acoustic characteristics relatively inexpensively.

(Pores)

It is preferred that the plurality of pores 4 are formed at least in the partial region of the surface layer of the wood material 1, evenly at a substantially regular pitch. As a result, the region of the wood material 1 having the plurality of pores 4 thus formed is enabled to be uniformly impregnated with the resin composition 2. In other words, the resin composition 2 is enabled to rapidly enter into the pores 4 and then gradually penetrate to a region adjacent to the outer surface of the wood material 1 and to regions adjacent to inner wall surfaces of the pores 4, but not enabled to penetrate to a deep region of the wood material 1 away from the pores 4.

In addition, a central axis direction of the plurality of pores 4 is preferably substantially perpendicular to a surface (outer surface on which the pores 4 are open) of the wood material 1. As a result, the wood material 1 is relatively easily impregnated with the resin composition 2 through the pores 4.

The lower limit of a ratio of the average diameter of the plurality of pores 4 to the average diameter of the vessels 3 in the wood material 1 is preferably 0.05, more preferably 0.10, and still more preferably 0.15. Meanwhile, the upper limit of the ratio of the average diameter of the plurality of pores 4 to the average diameter of the vessels 3 in the wood material 1 is preferably 1.2, more preferably 1.0, still more preferably 0.8, and yet more preferably 0.6. When the ratio of the average diameter of the plurality of pores 4 to the average diameter of the vessels 3 in the wood material 1 is less than the lower limit, the resin composition 2 may be less likely to enter into the pores 4. To the contrary, when the ratio of the average diameter of the plurality of pores 4 to the average diameter of the vessels 3 in the wood material 1 is greater than the upper limit, strength of the tone bar woody material may be insufficient and/or appearance of the tone bar woody material may be unnatural.

The lower limit of the average diameter of the plurality of pores 4 is preferably 5 μm, more preferably 10 μm, still more preferably 15 μm, and particularly preferably 50 μm. Meanwhile, the upper limit of the average diameter of the plurality of pores 4 is preferably 500 μm, more preferably 200 μm, and still more preferably 100 μm. When the average diameter of the plurality of pores 4 is less than the lower limit, the resin composition 2 may be less likely to enter into the pores 4. To the contrary, when the average diameter of the plurality of pores 4 is greater than the upper limit, strength of the wood material 1 may be low and/or appearance of the wood material may be unnatural. It is to be noted that the smaller average diameter of the pores 4 requires the greater number of pores 4 to be formed. Accordingly, when the average diameter of the pores 4 is less than 50 μm, a planar arrangement pattern and/or a pitch of the pores 4 may need to be adjusted.

The lower limit of the average depth of the plurality of pores 4 is preferably 0.1 mm and more preferably 1 mm. Meanwhile, the upper limit of the average depth of the plurality of pores 4 is preferably 10 mm and more preferably 5 mm. According to the tone bar woody material, an impregnation depth of the resin composition 2 can be adjusted by the depths of the pores 4. When the average depth of the plurality of pores 4 is less than the lower limit, the impregnation of the wood material 1 with the resin composition 2 may not be sufficiently accelerated. To the contrary, when the average depth of the plurality of pores 4 is greater than the upper limit, strength (toughness) of the surface layer of the tone bar woody material against an impact may be insufficient, and/or natural sound may not be produced.

The pores 4 may be provided on both faces of the wood material 1. The lower limit of a sum of the average depth of the pores 4 on one face and the average depth of the pores 4 on the other face of the wood material 1 (when the pores 4 are provided only on one face, the average depth of the pores 4 on the one face) is preferably 1/50 and more preferably 1/40 of an average thickness of the wood material 1. Meanwhile, the upper limit of the sum of the average depths of the pores 4 is preferably 1/2 and more preferably 1/3 of the average thickness of the wood material 1. When the sum of the average depths of the pores 4 is less than the lower limit, the acoustic characteristics of the tone bar woody material may not be sufficiently improved. To the contrary, when the sum of the average depths of the pores 4 is greater than the upper limit, strength (toughness) of the surface layer of the tone bar woody material of the present embodiment against an impact may be insufficient, and/or natural sound may not be produced.

The lower limit of the average pitch of the pores 4 is preferably 0.2 mm and more preferably 0.5 mm. Meanwhile, the upper limit of the average pitch of the pores 4 is preferably 10 mm and more preferably 5 mm. When the average pitch of the pores 4 is less than the lower limit, toughness of the tone bar woody material may be insufficient, and/or natural sound may not be produced. To the contrary, when the average pitch of the pores 4 is greater than the upper limit, the wood material 1 may not be uniformly impregnated with the resin composition 2.

The lower limit of the number of the pores 4 per unit area is preferably 14 pores/$cm^2$ and more preferably 20.5 pores/$cm^2$. Meanwhile, the upper limit of the number of the pores 4 per unit area is preferably 900 pores/$cm^2$ and more preferably 350 pores/$cm^2$. When the number of the pores 4 per unit area is less than the lower limit, the impregnation of the wood material 1 with the resin composition 2 may not be sufficiently accelerated. To the contrary, when the number of the pores 4 per unit area is greater than the upper limit, the toughness of the surface layer of the tone bar woody material may be insufficient.

Resin Composition

As a principal component of the resin composition 2, a thermosetting resin is preferred which is low in viscosity upon the impregnation of the wood material 1 to consequently facilitate the impregnation, and can be easily hardened and fixed after the impregnation. It is to be noted that the term "principal component" as referred to means a component of which percentage content by mass is the greatest.

The thermosetting resin used as the principal component of the resin composition 2 is exemplified by an epoxy resin, a phenol resin, a urea resin, a polyester resin, an acrylic resin, a silicate resin, a melamine resin, a urethane resin, and the like. Of these, the epoxy resin, in particular a bisphenol-A type epoxy resin is preferably used.

A number average molecular weight of the thermosetting resin used as the principal component of the resin composition 2 upon the impregnation of the wood material 1 is preferably no less than 200 and no greater than 500. When the number average molecular weight of the thermosetting resin used as the principal component of the resin composition 2 upon the impregnation of the wood material 1 falls within the above range, the impregnation of the wood material 1 with the resin composition 2 is enabled, while the resin composition 2 is enabled to have sufficient strength after hardening.

In addition, the resin composition 2 upon the impregnation of the wood material 1 may contain, for example, a hardening agent for accelerating hardening, other resins for adjusting physical properties of the resin composition 2, a solvent for reducing viscosity and in turn accelerating the impregnation of the wood material 1.

Production Method

Figure 3:
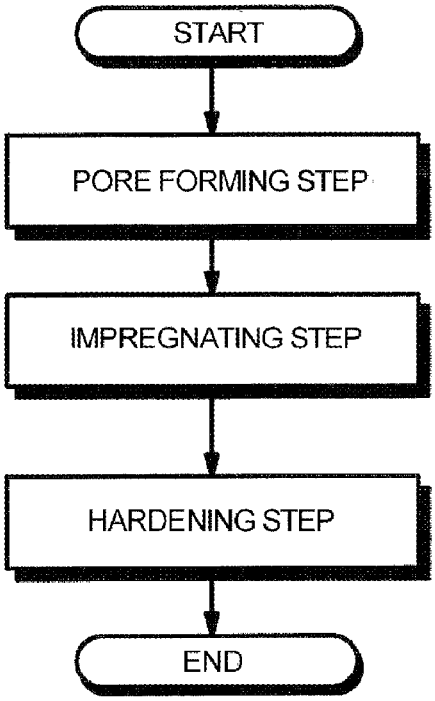
FIG. 3 is a flow chart showing steps of a production method of a tone bar woody material according to another embodiment of the present invention.

The tone bar woody material of the present embodiment can be produced by a method comprising, for example: a step of forming the plurality of pores 4 at least in the partial region of the surface layer of the wood material 1 (pore forming step); a step of impregnating with the resin composition 2 the wood material 1 having the pores 4 thus formed (impregnating step); and a step of hardening the resin composition 2 with which the wood material 1 had been impregnated (hardening step), as shown in FIG. 3.

Pore Forming Step

As a procedure for forming the pores 4, a procedure of piercing with a needle, a procedure of spraying a fluid, etc. may be employed; however, a procedure of using laser, i.e., a laser incision process is preferably employed from the perspective that small-diameter pores can be formed relatively accurately.

As a laser beam used for the incision process, an ultraviolet laser beam is suited. Due to using the ultraviolet laser beam, formation of the pores 4 is enabled through thermal decomposition of the wood material 1, with little residue (carbide etc.). Accordingly, relatively free adjustments of the diameter and the depth of the pores 4 are enabled. Specifically, a wavelength of the laser beam used for the incision process is preferably no less than 100 nm and no greater than 400 nm. For example, a UV-YAG laser (third harmonics) may be employed. When the wavelength of the laser beam falls within the above range, relatively easy optimizations of the diameter and the depth of the pores 4 to be formed are enabled.

An output power of the laser beam used for the incision process is preferably no less than 1 W and no greater than 10 W. When the output power of the laser beam falls within the above range, relatively easy optimizations of the diameter and the depth of the pores 4 to be formed are enabled.

Impregnating Step

In the impregnating step, the wood material 1 is impregnated with the resin composition 2 which is unhardened. The impregnating step preferably includes reduced pressure impregnation of impregnating the wood material with the resin composition 2 while deaerating the wood material 1 under reduced pressure, and ordinary pressure impregnation of impregnating the wood material 1 with the resin composition 2 under ordinary pressure. Due to including the reduced pressure impregnation, the impregnation with the resin composition 2 is enabled to be accelerated, and consequently stabilization of a quality of the tone bar woody material to be obtained, and in turn, stabilization of qualities of a tone bar formed from the tone bar woody material and an instrument provided with the tone bar, are enabled. In addition, due to including the ordinary pressure impregnation, the impregnation with the resin composition 2 is enabled to be further accelerated while a strain of the wood material 1 generated during the reduced pressure impregnation is eliminated.

A viscosity of the resin composition 2 in the impregnating step is preferably no less than 10 mPa·s and no greater than 1 Pa·s. When the viscosity of the resin composition 2 falls within the above range, the wood material 1 is enabled to be impregnated with the resin composition 2 relatively efficiently.

(Reduced Pressure Impregnation)

Owing to the reduced pressure impregnation, the surface layer of the wood material 1 (regions adjacent to the pores 4) is enabled to be impregnated with the resin composition 2 relatively evenly and rapidly.

A pressure for the reduced pressure impregnation may be, for example, no less than −0.101 MPa and no greater than −0.05 MPa in gauge pressure. When the pressure for the reduced pressure impregnation falls within the above range, the impregnation of the wood material 1 with the resin composition 2 is enabled to be accelerated without unnecessarily increasing the production cost.

An impregnation time period in the reduced pressure impregnation may be, for example, no less than 30 min and no greater than 180 min. When the impregnation time period in the reduced pressure impregnation falls within the above range, the surface layer of the wood material 1 is enabled to be impregnated with the resin composition 2, selectively and relatively uniformly. It is to be noted that the impregnation time period in the reduced pressure impregnation may be longer than the above-specified period, within a range not leading to hardening of the resin in the resin composition 2.

(Ordinary Pressure Impregnation)

Owing to the ordinary pressure impregnation, elimination of a strain of the wood material 1 generated due to the reduced pressure in the reduced pressure impregnation, and reduction of a residual stress of the tone bar woody material to be obtained are enabled. A temperature in the ordinary pressure impregnation may be the same as a temperature in the reduced pressure impregnation.

An impregnation time period in the ordinary pressure impregnation may be, for example, no less than 30 min and no greater than 180 min. When the impregnation time period in the ordinary pressure impregnation falls within the above range, the wood material 1 is enabled to be impregnated with the resin composition 2 relatively uniformly. It is to be noted that the impregnation time period in the ordinary pressure impregnation may be similarly longer than the above-specified period, within a range not leading to hardening of the resin in the resin composition 2.

(Hardening Step)

In the hardening step, the resin composition 2 with which the wood material 1 had been impregnated is hardened through polymerization of the resin, which is the principal component of the resin composition 2. The resin composition 2 thus hardened improves the vibration characteristics of the wood material 1 to approximate to the vibration characteristics of a higher-class material. A procedure for hardening the resin composition 2 is selected according to a constitution of the resin composition 2, and heating is typically used.

A heating temperature in the hardening step is selected according to a type of hardening agent, and may be, for example, no less than 120° C. and no greater than 200° C. When the heating temperature in the hardening step falls within the above range, the hardening of the resin composition 2 is enabled to be accelerated.

A heating time period in the hardening step is selected according to a type of hardening agent, and may be, for example, no less than 30 min and no greater than 120 min. When the heating time period in the hardening step falls within the above range, relatively efficient hardening of the resin composition 2 is enabled, and prevention of a crack generated due to a reduced moisture content in the wood material 1 is enabled.

Advantages

In the tone bar woody material of the present embodiment, due to the plurality of pores 4 formed in the surface layer of the wood material 1 at least the partial region of which is to be impregnated with the resin composition 2, the plurality of pores 4 each having the average diameter less than 1.2 times the average diameter of the vessels 3 in the wood material 1, the resin enters into the pores 4 relatively easily, and consequently, relatively uniform impregnation with a desired amount of the resin is enabled irrespective of individual variability of the wood material 1 and non-homogeneity of its inner tissue. More specifically, in the tone bar woody material of the present embodiment, due to the plurality of pores 4 formed by the incision process in the region of the surface layer of the wood material 1 to be impregnated with the resin composition 2, the plurality of pores 4 each having the average diameter smaller than the average diameter of the vessels 3 in the wood material 1, the impregnation with the resin composition 2 is facilitated. In other words, the resin composition 2 first enters rapidly into the plurality of pores 4, and the vessels 3 which are open on the surface of the wood material 1 and on the inner wall of the pores 4, and then, via the pores 4 and the vessels 3, gradually permeates to surrounding regions. As a result, the tone bar woody material of the present embodiment has improved acoustic characteristics and a stable quality, owing to the impregnation in a relatively constant depth with a relatively constant amount of the resin, irrespective of the individual variability of the wood material 1.

Xylophone

A xylophone (tone bar percussion instrument) according to another embodiment of the present invention is provided with a plurality of tone bars formed from the tone bar woody material of FIG. 1. In other words, in the xylophone of the present embodiment, the plurality of tone bars that produce a plurality of musical notes are each formed from the tone bar woody material of the embodiment described above.

Specifically, the tone bars in the xylophone are each formed in such a shape that a predetermined natural frequency corresponding to each musical note is generated, by cutting down the tone bar woody material from faces other than a top face being a struck surface impregnated with the resin composition 2.

Due to each tone bar being formed from the tone bar woody material of the embodiment described above, the xylophone of the present embodiment is superior in the acoustic characteristics and stable in quality. In addition, the xylophone of the present embodiment is capable of producing high-class tone for the price.

Other Embodiments

The embodiments described above do not restrict the constituent features of the present invention. Therefore, any omission, substitution and addition of each of the constituent features of the embodiments can be made on the basis of the description of the present specification and common general technical knowledge, and such omitted, substituted and/or added features are to be construed to entirely fall under the scope of the present invention.

In the tone bar woody material, a plurality of faces of the wood material may have the pores being formed and may be impregnated with the resin. Alternatively, in the tone bar woody material, only a partial region of one face of the wood material may have the pores being formed and may be impregnated with the resin. Yet alternatively, in the tone bar woody material, only a part of the region to be impregnated with the resin may have the pores being formed.

Although, in the embodiment illustrated in the drawings, a cross grain surface of the wood material has the pores and is impregnated with the resin, a straight grain surface and an end grain surface of the wood material may also have the pores and may be impregnated with the resin.

The resin composition used in the tone bar woody material of the embodiment described above may contain a thermoplastic resin as the principal component. In this case, the resin composition after the impregnation is preferably hardened through polymerization.

The tone bar percussion instrument according to the present invention is not limited to the xylophone, and may also be, for example, a castanet, a wood block, a cajon, a wooden fish, or the like.

EXAMPLES

Hereinafter, the present invention is described in detail by way of Examples, but the present invention should not be restrictively construed as being limited on the basis of the description of the Examples.

PRODUCTION EXAMPLES OF WOODEN TONE BAR MATERIAL

Production Examples 1 to 4 of the wooden tone bar material were produced as follows, and unprocessed solid wood boards were provided as Comparative Examples 1 and 2. Thereafter, a hammering test was conducted.

Production Example 1

As a wood material, a general-purpose grade padauk board of 60 mm in width, 350 mm in length, and 25 mm in thickness was provided. Production Example 1 was obtained by entirely subjecting one face of the wood material to the incision process and then to the impregnation with the resin composition.

An average diameter of vessels in the wood material, calculated from diameters measured by image processing with an optical microscope, was 206 μm.

The incision process (pore formation) was carried out by perpendicularly irradiating the one face with a laser beam for 8 msec, by using a UV laser apparatus with an output power of 4 W (100%), a wavelength of 355 nm, and a frequency of 50 kHz. The pores were arranged in a square at a regular interval in length and breadth directions, with a pitch (center-to-center distance) being 2.5 mm.

The pores formed by the incision process had an average diameter of 113 μm (55% of average diameter of the vessels) and an average depth of 3 mm.

The wood material with the pores was impregnated with a resin composition containing a bisphenol-A type epoxy resin as a principal component.

The resin composition with which the wood material was to be impregnated was prepared by blending: jER828 (available from Mitsubishi Chemical Corporation) as the bisphenol-A type epoxy resin; 1,6-hexanediol diglycidyl ether as a reactive diluent; and 2-ethyl-4-methylimidazole as an imidazole hardening agent, at a ratio of 95:5:30.

With the above-described resin composition, the reduced pressure impregnation and then the ordinary pressure impregnation were carried out. The reduced pressure impregnation was carried out for 1 hour at a gauge pressure of −0.1 MPa. The ordinary pressure impregnation was carried out for 1 hour at ambient pressure.

Production Example 1 was obtained by heating the wood material thus impregnated with the resin composition, at 180° C. for one hour to harden the resin composition.

Production Example 2

Production Example 2 was obtained under the same conditions as Production Example 1, except that the output power of the laser beam was 3 W (75%). The pores in Production Example 2 had an average diameter of 91 μm (44% of average diameter of the vessels) and an average depth of 3 mm.

Production Example 3

Production Example 3 was obtained under the same conditions as Production Example 1, except that the output power of the laser beam was 2 W (50%). The pores in Production Example 2 had an average diameter of 73 μm (35% of average diameter of the vessels) and an average depth of 3 mm.

Production Example 4

Production Example 4 was obtained under the same conditions as Production Example 1, except that the output power of the laser beam was 1 W (25%). The pores in Production Example 2 had an average diameter of 53 μm (26% of average diameter of the vessels) and an average depth of 3 mm.

Comparative Example 1

As Comparative Example 1, a board material having the same size as Production Examples 1 to 4 cut out from solid honduran rosewood, which is a high-quality material for tone bars, was provided.

Comparative Example 2

As Comparative Example 2, the wood material used for preparing Production Examples 1 to 4 was provided.

Evaluation Test

Production Examples 1 to 4 and Comparative Example 1 and 2 were struck with a mallet, and sounds thus produced were sensorially evaluated by 10 participants.

Tone produced by Comparative Example 2, which was an unprocessed inexpensive natural wood, was obviously inferior to that of Comparative Example 1, which was a relatively high-quality natural wood. On the other hand, it was confirmed that Production Examples 1 to 4, having been subjected to the incision process and the impregnation with the resin composition, produced sound similar to that of Comparative Example 1.

INDUSTRIAL APPLICABILITY

The tone bar woody material according to the present invention can be used particularly suitably for forming tone bars for tone bar percussion instruments for intermediate and advanced players.

EXPLANATION OF THE REFERENCE SYMBOLS

1 Wood material
2 Resin composition
3 Vessel
4 Pore

The invention claimed is:

1. A tone bar woody material comprising:
a wood material provided with vessels with a predetermined average diameter; and
a resin composition,
wherein at least a partial region of a surface layer of the wood material is impregnated with the resin composition, and
wherein the wood material, in the partial region, is provided with a plurality of pores each having an average diameter that is no less than 10 μm and no greater than 500 μm, which is less than 1.2 times the predetermined average diameter of the vessels in the wood material.

2. The tone bar woody material according to claim 1, wherein a central axis direction of the plurality of pores is substantially perpendicular to a surface of the wood material.

3. The tone bar woody material according to claim 1, wherein an average depth of the plurality of pores is no less than 0.1 mm and no greater than 10 mm.

4. The tone bar woody material according to claim 1, wherein an average pitch of the plurality of pores is no less than 0.2 mm and no greater than 10 mm.

5. The tone bar woody material according to claim 1, wherein number of the plurality of pores per unit area is no less than 14 pores/$cm^2$ and no greater than 900 pores/$cm^2$.

6. A tone bar percussion instrument including a tone bar woody material, the tone bar percussion instrument comprising:

a wood material provided with vessels with a predetermined average diameter; and a resin composition, wherein at least a partial region of a surface layer of the wood material is impregnated with the resin composition, wherein the wood material, in the partial region, is provided with a plurality of pores each having an average diameter that is no less than 10 μm and no greater than 500 μm, which is less than 1.2 times the predetermined average diameter of the vessels in the wood material.

7. A production method of a tone bar woody material comprising a wood material provided with vessels with a predetermined average diameter, and a resin composition, the production method comprising:

manipulating the wood material, in a partial region of a surface layer of the wood material, to form a plurality of pores each with an average diameter that is no less than 10 μm and no greater than 500 μm, which is less than 1.2 times the average diameter of vessels in the wood material;

impregnating at least the partial region provided with the plurality of pores with the resin composition; and hardening the resin composition.

8. The production method according to claim 7, wherein the impregnating comprises:

impregnating the wood material with the resin composition while deaerating the wood material under subatmospheric pressure; and then impregnating the wood material with the resin composition under ordinary pressure.

* * * * *